US008809712B2

(12) United States Patent
Kobayashi et al.

(10) Patent No.: US 8,809,712 B2
(45) Date of Patent: Aug. 19, 2014

(54) SWITCH CASE WITH PARTITIONED PASSAGES

(75) Inventors: Minoru Kobayashi, Okayama (JP); Taiki Koyama, Okayama (JP)

(73) Assignee: Omron Corporation, Kyoto (JP)

( * ) Notice: Subject to any disclaimer, the term of this patent is extended or adjusted under 35 U.S.C. 154(b) by 165 days.

(21) Appl. No.: 13/530,215

(22) Filed: Jun. 22, 2012

(65) Prior Publication Data

US 2013/0037398 A1 Feb. 14, 2013

(30) Foreign Application Priority Data

Aug. 12, 2011 (JP) ..... 2011-176919

(51) Int. Cl.
*H01H 9/02* (2006.01)

(52) U.S. Cl.
USPC ..... 200/306

(58) Field of Classification Search
USPC ..... 200/306, 302.1
IPC ..... H01H 9/346,9/04, 9/047, 13/06, 19/06, H01H 21/08, 23/06, 85/0021, 2009/04, 2013/06
See application file for complete search history.

(56) References Cited

U.S. PATENT DOCUMENTS 3,652,811 A * 3/1972 Barney ..... 200/5 EB
4,324,956 A * 4/1982 Sakakino et al. ..... 200/16 R
4,839,483 A * 6/1989 Doyle ..... 200/302.1
5,343,008 A * 8/1994 Ipcinski ..... 200/302.2
5,463,198 A * 10/1995 Shimaoka ..... 200/531
5,862,029 A * 1/1999 Nicol ..... 361/42
7,211,758 B2 * 5/2007 Lui ..... 200/447
7,289,306 B2 * 10/2007 Huang et al. ..... 361/42
7,511,240 B2 * 3/2009 Inagaki et al. ..... 200/522
2007/0219409 A1 * 9/2007 Shimizu et al. ..... 600/112

FOREIGN PATENT DOCUMENTS

JP 200593347 A 4/2005

* cited by examiner

*Primary Examiner* — Vanessa Girardi
(74) *Attorney, Agent, or Firm* — Karl F. Milde, Jr.; Eckert Seamans Cherin & Mellott, LLC

(57) ABSTRACT

A switch designed for dustproof performance by minimizing a route of entry of dust from a terminal portion, includes a plurality of terminals, a movable contact piece that is supported in a manner allowing displacement between a non-conduction position and a conduction position, and a contact actuating member that displaces the movable contact piece in response to an externally applied pressing force. A main body of the switch includes an opening communicating with the outside, partition walls formed between the opening and the movable contact piece, barrier walls formed between the opening and the movable contact piece, and passages formed by ends of the barrier walls and walls that are opposite the ends of the barrier walls. Each partition wall extends across the corresponding passage and each terminal includes a connection portion and a blocking portion that is bent from the connection portion and blocks the corresponding passage.

4 Claims, 9 Drawing Sheets

SWITCH CASE WITH PARTITIONED PASSAGES

BACKGROUND OF THE INVENTION

1. Technical Field

The present invention relates to a switch which is installed in a grip of power tool or the like and can start the power tool when a user pulls in the switch with the fingers.

2. Related Art

Conventionally, in order to prevent dust from entering the inside of a switch from a terminal hole, various methods are proposed including a method in which terminals are insert-molded in a housing of the switch, and a large amount of grease is spread between the terminal and the housing, and the like.

For instance, Japanese Patent Application Laid-Open No. 2005-93347 discloses a switch which prevents dust from entering the inside of a main body thereof by employing a structure in which a fixed contact thereof is insert-molded.

However, this switch is disadvantageous in that the manufacturing cost is increased due to the insert molding. Moreover, the method of spreading a large amount of grease is also likely to be disadvantageous because the production cost increases due to an increase in the number of manufacturing processes and operation failures which occur due to the grease adhering to the contacts inside the housing.

The present invention has been made to alleviate the above-mentioned problems.

SUMMARY OF THE INVENTION

A principal object of the invention is to provide a switch that reduces manufacturing cost by the absence of a special structure and that has an excellent dustproof performance by preventing dust from entering from a terminal hole.

As a means for solving the above-mentioned problems, in accordance with one aspect of the invention, there is provided a switch including a plurality of terminals fixed to a main body; a movable contact piece that is supported on the main body in a manner allowing displacement between a non-conduction position where the terminals are not connected to each other and a conduction position where the terminals are connected to each other; and a contact actuating member that is accommodated in the main body and displaces the movable contact piece from the non-conduction position to the conduction position in response to an external pressing force. The main body includes an opening that communicates with the outside, a partition wall formed between the opening and the movable contact piece, a barrier wall formed above the partition wall, and a passage formed by an end portion of the barrier wall and a wall that is opposite the end portion of the barrier wall. The partition wall extends across the passage, and the terminal includes a connection portion that is connected to a conductor which passes through the opening and a blocking portion that is bent from the connection portion and blocks the passage.

According to this aspect of the invention, since the partition wall crosses the passage, a sectional area of a route of entry of dust from the opening to the inside of the switch is minimized and the blocking portion of the terminal blocks the route of entry, resulting in excellent dustproof performance. Moreover, since the terminal needs not have a special structure, the manufacturing cost can be reduced.

In this aspect, the partition wall may include a guide groove used to spread a viscous material between the terminal and the partition wall. According to this aspect, since the viscous material is spread between the partition wall and the terminal using the guide groove, a gap between the partition wall and the terminal can be sealed. Accordingly, dust can be prevented from entering the inside of the main body. Moreover, since the viscous material is spread only between the partition wall and the terminal, the amount of the viscous material spread for dust proofing can be reduced, and therefore the manufacturing cost can also be reduced.

According to another aspect of the invention, the switch includes a cover that covers the main body, and the main body further includes a reinforcement portion that fixes the cover in between the barrier wall and the movable contact piece. A reinforcement portion-side passage is formed by the reinforcement portion and a wall that is opposite the reinforcement portion, and the blocking portion of the terminal blocks the reinforcement portion-side passage. According to this second aspect of the invention, since the blocking portion blocks the reinforcement portion-side passage, two places, i.e., the passage and the reinforcement portion-side passage, are blocked up. Therefore, dust from the opening is prevented from entering the inside, resulting in a further improvement in the dustproof performance of the switch.

According to still another aspect of the invention, the main body includes a protrusion provided between the barrier wall and the movable contact piece. The terminal has a bent portion that is bent from the blocking portion on the opposite side of the connection portion of the terminal, and the bent portion is locked to the protrusion. According to this third aspect of the invention, dust that has entered from the opening is sealed by the bent portion and the protrusion. This dust is prevented from arriving at the movable contact piece, thus further improving the dustproof performance of the switch.

For a full understanding of the present invention, reference should now be made to the following detailed description of the preferred embodiments of the invention as illustrated in the accompanying drawings.

DETAILED DESCRIPTION

Embodiments of a switch 11 according to the present invention are described below in reference to the accompanying drawings, FIGS. 1 to 9B. Identical elements shown in the various figures are identified with the same reference numbers.

As illustrated in FIGS. 1 to 4, the switch 11 includes: a main body 21 (see FIG. 3) with an opening on the front side; and a cover 46 to cover the main body 21. A switch assembly 50 to be described later is accommodated in the interior space of the main body 21.

Figure 5:
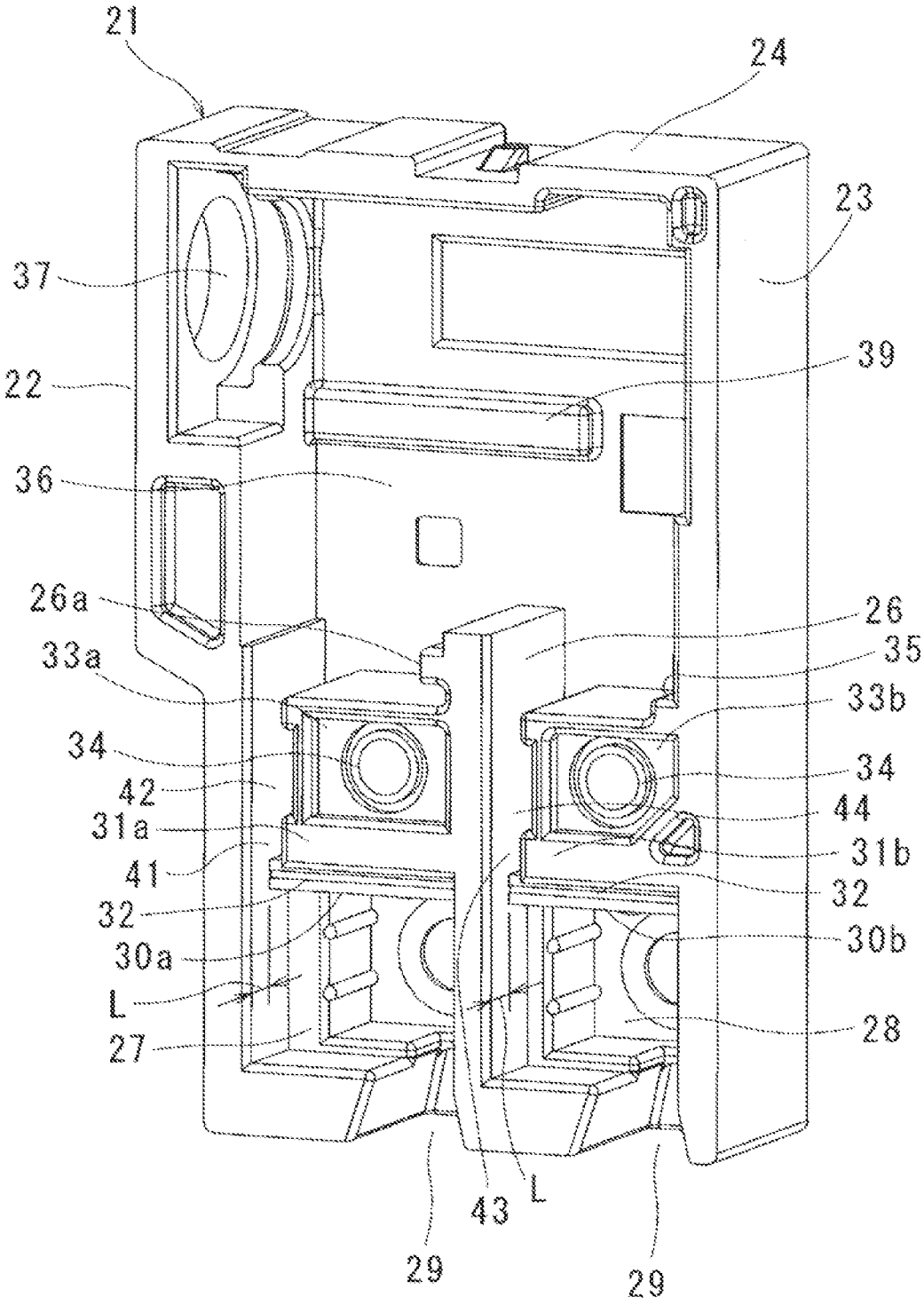
FIG. 5 is a perspective view illustrating a main body illustrated in FIG. 3.

As illustrated in FIG. 5, the main body 21 includes a front frame 22, a rear frame 23, and an upper frame 24 which is located above the front frame 22 and the rear frame 23. A standing wall 26 is formed to extend upward from a center portion of a lower end of the main body 21, and a first protrusion 26*a* is formed to protrude from the upper end of the standing wall 26 toward the front frame 22. In addition, at a lower portion of the standing wall 26, a first accommodation space 27 is provided between the standing wall 26 and the front frame 22, and a second accommodation space 28 is provided between the standing wall 26 and the rear frame 23.

Two conductor insertion openings 29 through which conductors are externally inserted are provided at lower ends of the first accommodation space 27 and the second accommodation space 28, respectively. The top of the first accommodation space 27 is partitioned by a first partition wall 30*a* which extends horizontally from a middle portion of the standing wall 26 to the front frame 22. The top of the second accommodation space 28 is partitioned by a second partition wall 30*b* which extends horizontally from a lower portion of the rear frame 23 to the standing wall 26. Grease guide grooves 32 are formed along the side end surfaces of these partition walls 30*a* and 30*b*. Moreover, the partition walls 30*a* and 30*b* are located deep inside by a dimension L with respect to the side end surfaces of the front frame 22 and the standing wall 26 which are flush with each other. The dimension L is preferably short. Such a configuration allows a reduction in a sectional area of a route between the first accommodation space 27 and a first passage 41 to be described later, and a sectional area of a route between the second accommodation space 28 and a second passage 43 to be described later, so that dust which has entered from the insertion holes 29 is prevented from arriving at a third accommodation space 36.

A first barrier wall 31*a* that horizontally extends from the standing wall 26 toward the front frame 22 is provided on the first partition wall 30*a*. Similarly, a second barrier wall 31*b* that horizontally extends from the standing wall 26 toward the rear frame 23 is provided on the second partition wall 30*b*. There are predetermined gaps, respectively, between a leading end of the first barrier wall 31*a* and the front frame (opposite wall) 22 which is opposite the leading end and between a leading end of the second barrier wall 31*b* and the standing wall 26 (opposite wall) which is opposite the leading end, and the gaps form the first passage 41 and the second passage 43, respectively.

A first reinforcement portion 33*a*, which is configured in a substantially rectangular parallelepiped shape and which is formed to extend from an interior surface of the main body 21 is provided on the top of the first barrier wall 31*a*, and, similarly, a second reinforcement portion 33*b* is provided on the top of the second barrier wall 31*b*. These reinforcement portions 33*a* and 33*b*, each have a through-hole 34 that extends through the main body 21. A second protrusion 35, that protrudes from the rear frame 23 toward the standing wall 26, is formed in an upper base portion of the second reinforcement portion 33*b*. Predetermined gaps are provided between the first reinforcement portion 33*a* and the front frame 22 (opposite wall) and between the second reinforcement portion 33*b* and the standing wall 26 (opposite wall). The predetermined gaps form a first reinforcement portion-side passage 42 and a second reinforcement portion-side passage 44, respectively.

The third accommodation space 36 which is partitioned by the front frame 22, the rear frame 23, and the upper frame 24 and which has a larger volume than the first accommodation space 27 and the accommodation space 28 is formed above the first and second reinforcement portions 33*a* and 33*b*. The third accommodation space 36 communicates with the outside through a round hole 37 formed in an upper portion of the front frame 22, and an operation shaft 77 of a contact actuating member 71 to be described later passes through the round hole 37. An annular dustproof ring 38 (FIG. 3) is arranged around the round hole 37 to seal a clearance between the round hole 37 and the operation shaft 77. An engagement rib 39, which extends horizontally, protrudes inward from the interior surface in the third accommodation space 36, and a guide 72 of the contact actuating member 71 to be described later engages with the engagement rib 39.

Further, the first accommodation space 27 communicates with the third accommodation space 36 through the first passage 41 and the first reinforcement portion-side passage 42. Similarly, the second accommodation space 28 communicates with the third accommodation space 36 through the second passage 43 and the second reinforcement portion-side passage 44.

Figure 1:
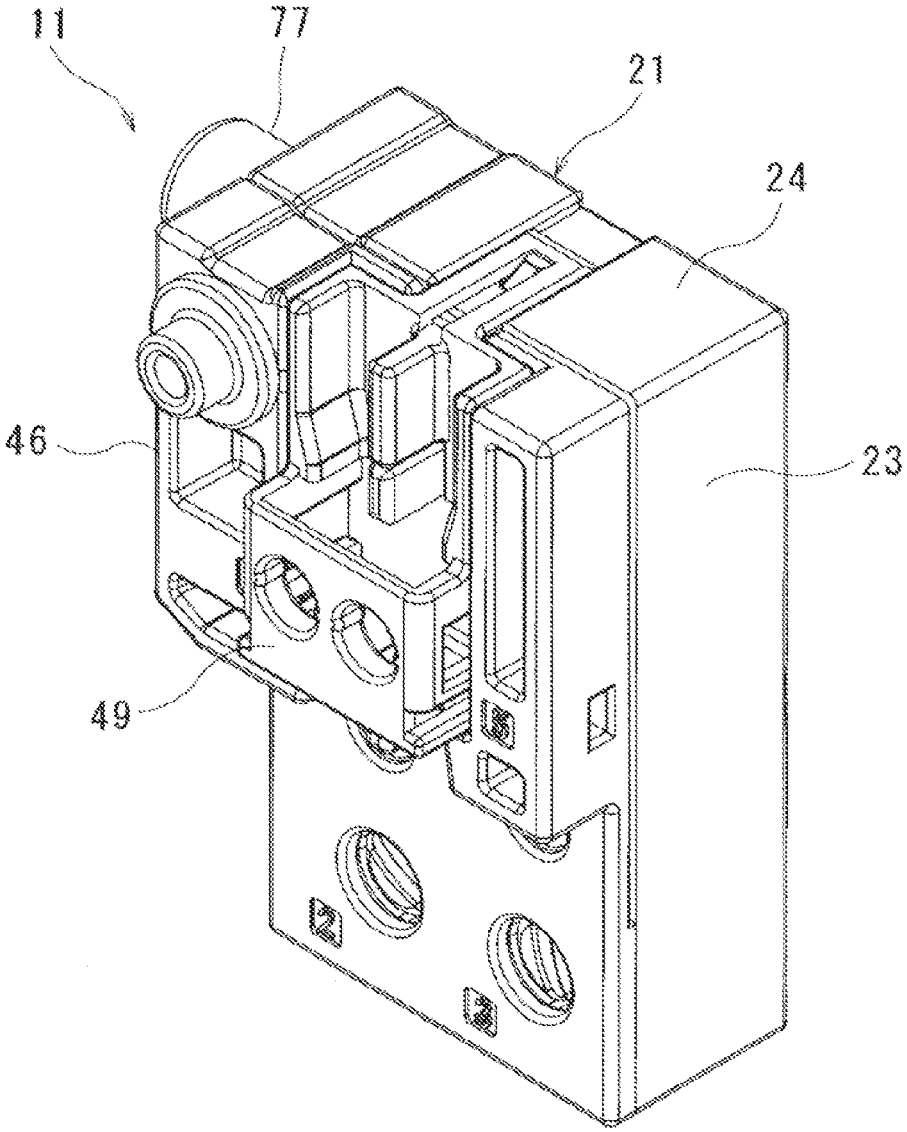
FIG. 1 is a perspective view illustrating an embodiment of a switch according to the present invention which is seen from above.
Figure 2:
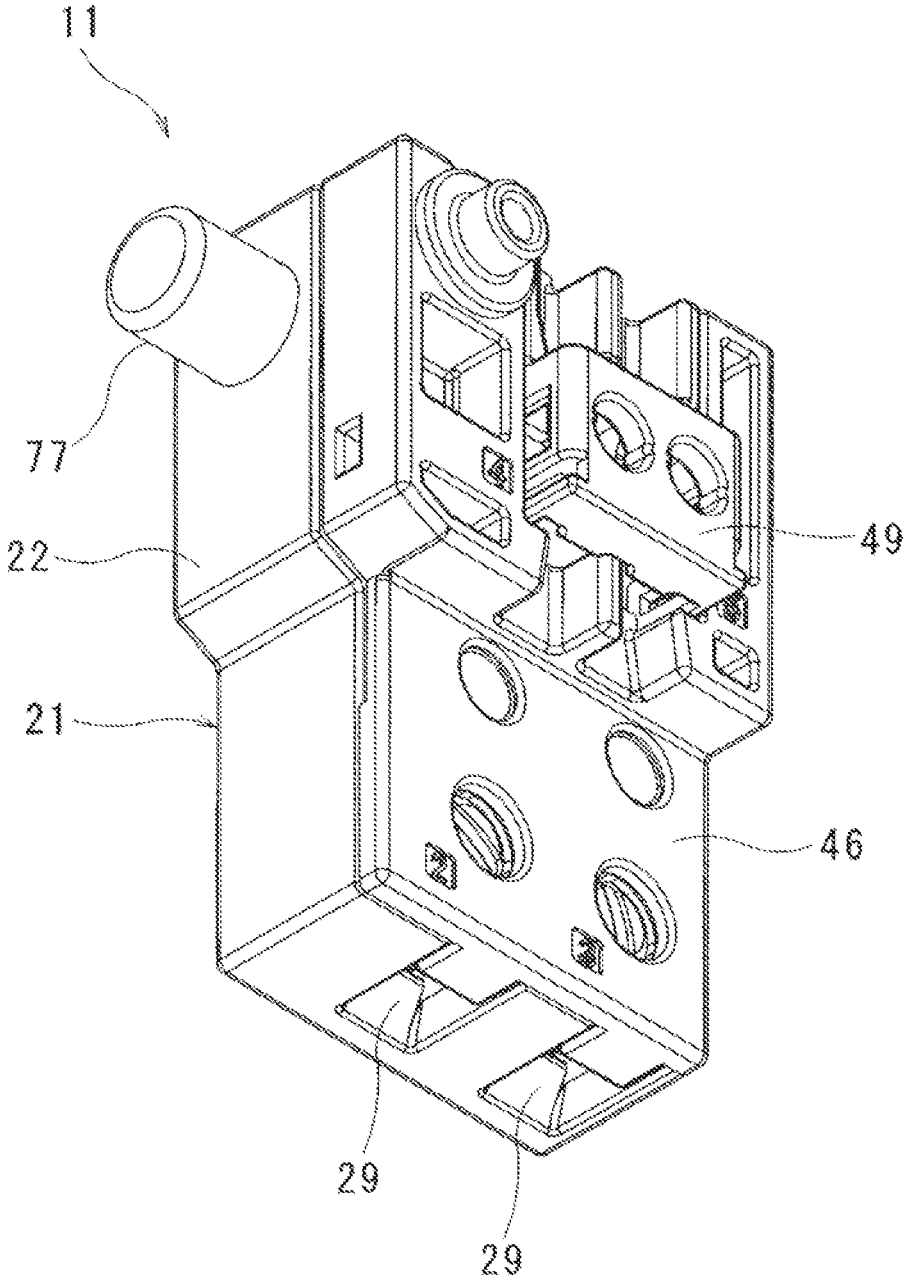
FIG. 2 is a perspective view which illustrates the switch of FIG. 1 and is seen from below.
Figure 3:
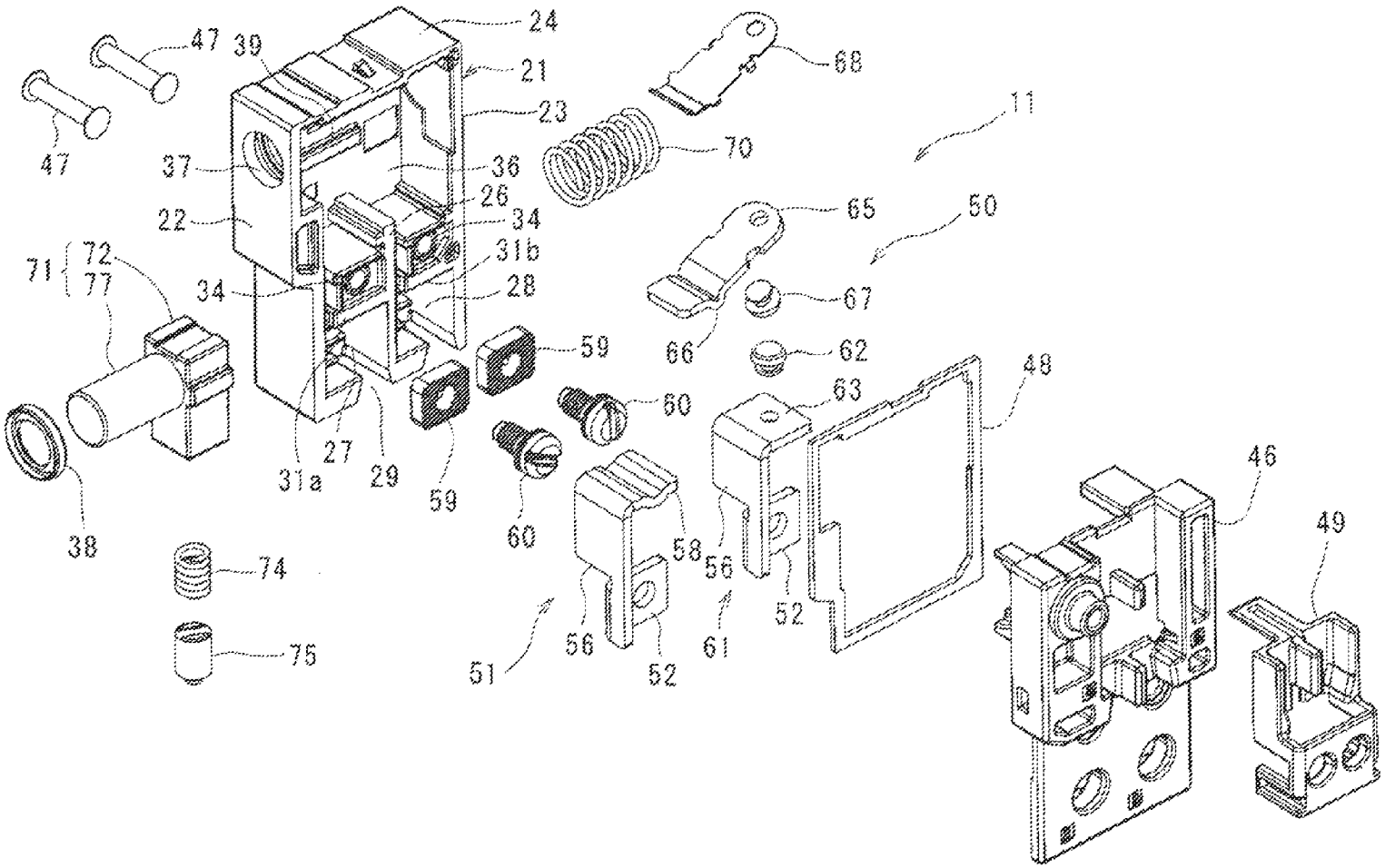
FIG. 3 is an exploded perspective view of the switch of FIG. 2.

As shown in FIG. 3, the front side of the cover 46 is shaped to cover the main body 21 and the cover 46 is locked to the main body 21 with a frame-shaped gasket 48 interposed therebetween by a pair of pins 47 that are inserted through the through-holes 34 of the main body 21. A motor splicer 49 that connects a power supply line to a motor is attached to the front surface of the cover 46.

Figure 6:
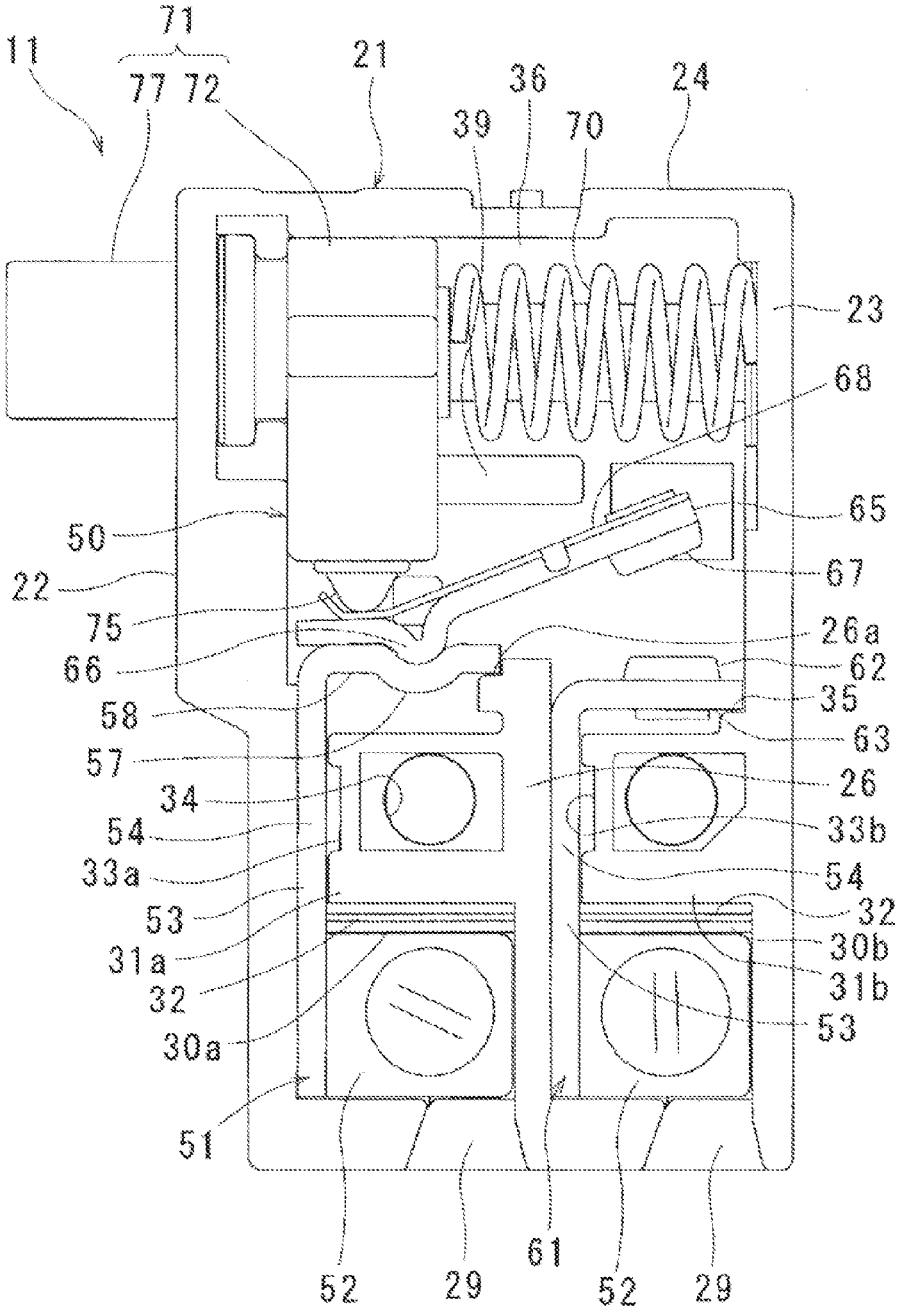
FIG. 6 is a front view illustrating the switch before being operated, with a cover removed.

As illustrated in FIG. 6, the switch assembly 50 includes a common terminal 51 and a fixed contact terminal 61 which are connected to an external circuit with a conductor such as a lead wire or a terminal which is not illustrated interposed therebetween, a movable contact piece 65 which is turnably supported on the common terminal 51 and the fixed contact terminal 61, and the contact actuating member 71 which is accommodated in the main body 21 in a slidable manner with a return spring 70 interposed therebetween. The movable contact piece 65 turns between a non-conduction position where the common terminal 51 and the fixed contact terminal 61 are not connected to each other and a conduction position where both of them are connected to each other. The contact actuating member 71 allows a movable contact piece 65 to turn from the non-conduction position to the conduction position in response to an external pressing force applied by the user, against the resisting elastic force of the return spring 70.

Figure 8A:
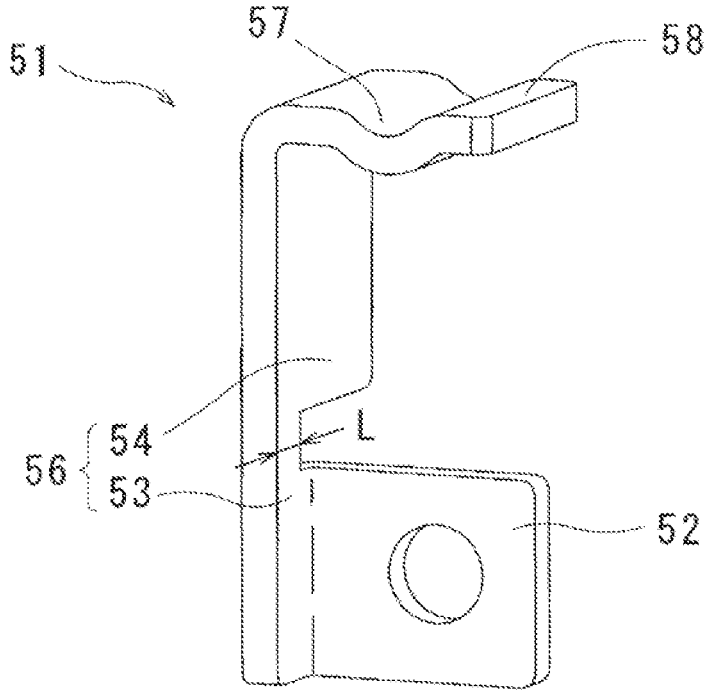
FIG. 8A is a perspective view of a common terminal, seen from one side.
Figure 8B:
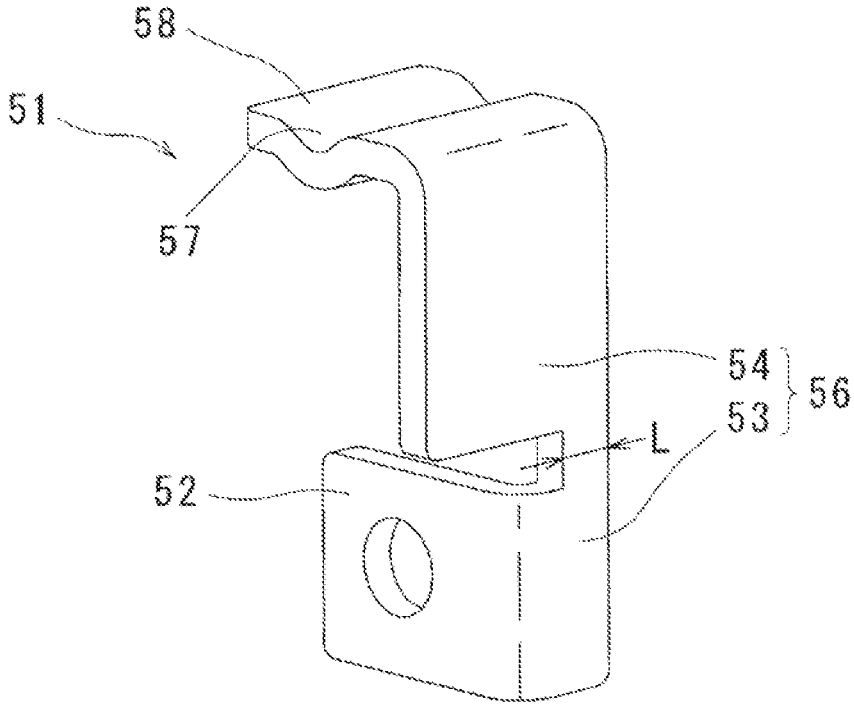
FIG. 8B is a perspective view of the common terminal seen from the side opposite to that shown in FIG. 8A.

As illustrated in FIG. 8, the common terminal 51 includes a rectangular external-side connection portion 52 to be connected with a conductor such as a lead wire or a terminal (not shown), a blocking portion 56 which is bent at a right angle with respect to the external-side connection portion 52, and a turn support portion 58 which is bent at a right angle from an upper end of the blocking portion 56 and then extends in a horizontal direction. The blocking portion 56 includes a prop 53 extending in a vertical direction and having a width dimension L, and a plate-shaped portion 54 extending upward from the prop 53 and having a large width. The width dimension L of the prop 53 is preferably short and it is equal to a depth dimension L of each of the first and second partition walls 30*a* and 30*b*. The turn support portion 58 includes a concave portion 57 which supports the turn center of the movable contact piece 65.

The common terminal 51 mounted in the main body 21 is connected with a conductor such as a lead wire or a terminal (not shown) passing through the conductor insertion hole 29 of the main body 21. The external-side connection portion 52 of the common terminal 51 is accommodated in the first accommodation space 27 of the main body 21. The lead wire is pinched between the external-side connection portion 52 and a rectangular washer 59 accommodated in the first accommodation space 27, and it is fixed by a screw 60 (FIG. 3). The blocking portion 56 is fitted in the first passage 41 and the first reinforcement portion-side passage 42 of the main body 21. Moreover, the turn support portion 58 is accommodated in a lower portion of the third accommodation space 36 and is locked to the first protrusion 26*a* of the standing wall 26 (FIG. 6).

Figure 9A:
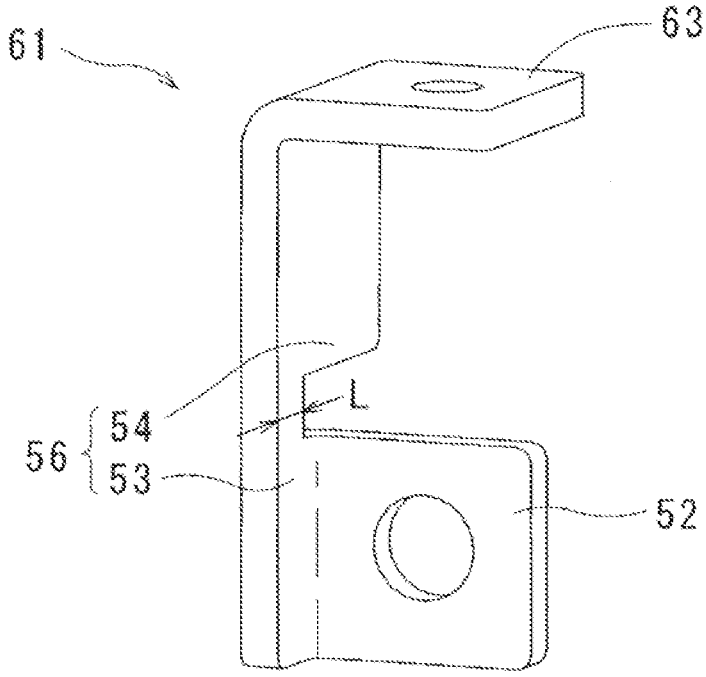
FIG. 9A is a perspective view of a common terminal, seen from one side
Figure 9B:
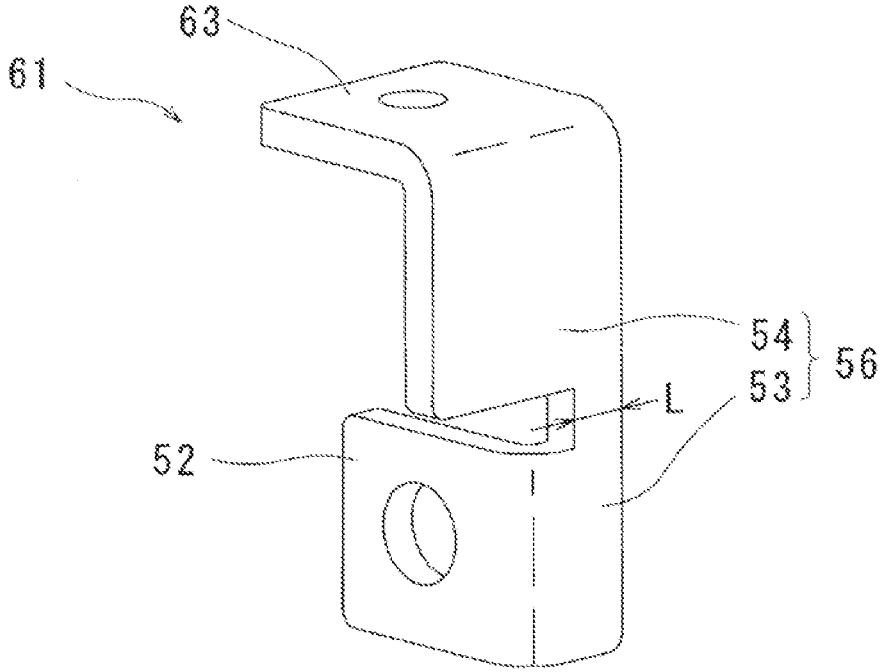
FIG. 9B is a perspective view of the common terminal seen from the side opposite to that shown in FIG. 9A.

As shown in FIG. 9, like the common terminal 51, the fixed contact terminal 61 includes an external-side connection portion 52, a blocking portion 56, and a horizontal plane portion 63 that is folded and bent from an upper portion of the blocking portion 56 at a right angle. This portion 63 extends horizontally, and is provided with a fixed contact 62 (See FIG. 3) which is brought into contact with, or is separated from, the movable contact piece 65.

The fixed contact terminal 61 mounted in the main body 21 is connected with a conductor such as a lead wire or a terminal (not shown) through a conductor insertion hole 29 and the external-side connection portion 52 of the fixed contact terminal 61 is accommodated in the second accommodation space 28 of the main body 21. The lead wire is pinched between the external-side connection portion 52 and the rectangular washer 59 accommodated in the second accommodation space 28, and it is fixed by a screw 60. The blocking portion 56 is fitted in the second passage 43 and the second reinforcement portion-side passage 44 of the main body 21. Moreover, the horizontal plane portion 63 is accommodated in a lower portion of the third accommodation space 36 and is locked to the second protrusion 35 of the rear frame 23.

The movable contact piece 65 has a long-plate shape as illustrated in FIG. 3 and includes a turning portion 66 serving as the turn center between the non-conduction position and the conduction position. The turning portion 66 is formed to protrude downward in the vicinity of an end of the movable contact piece 65. A movable contact 67 is attached to the other end of the movable contact piece 65 in such a manner that it is brought into contact with the fixed contact 62. Moreover, a slide contact plate 68 which is substantially the same in shape as the movable contact piece 65 is attached to the top surface of the movable contact piece 65, and the movable contact piece 65 and the contact actuating member 71 are slidably in contact with each other with the slide contact plate 68 interposed therebetween. Further, the movable contact piece 65 mounted in the main body 21 is disposed on top of the common terminal 51 and the fixed contact terminal 61 in the third accommodation space 36. The turning portion 66 thereof engages with the concave portion 57 of the common terminal 51 so as to be turnably supported.

Figure 4:
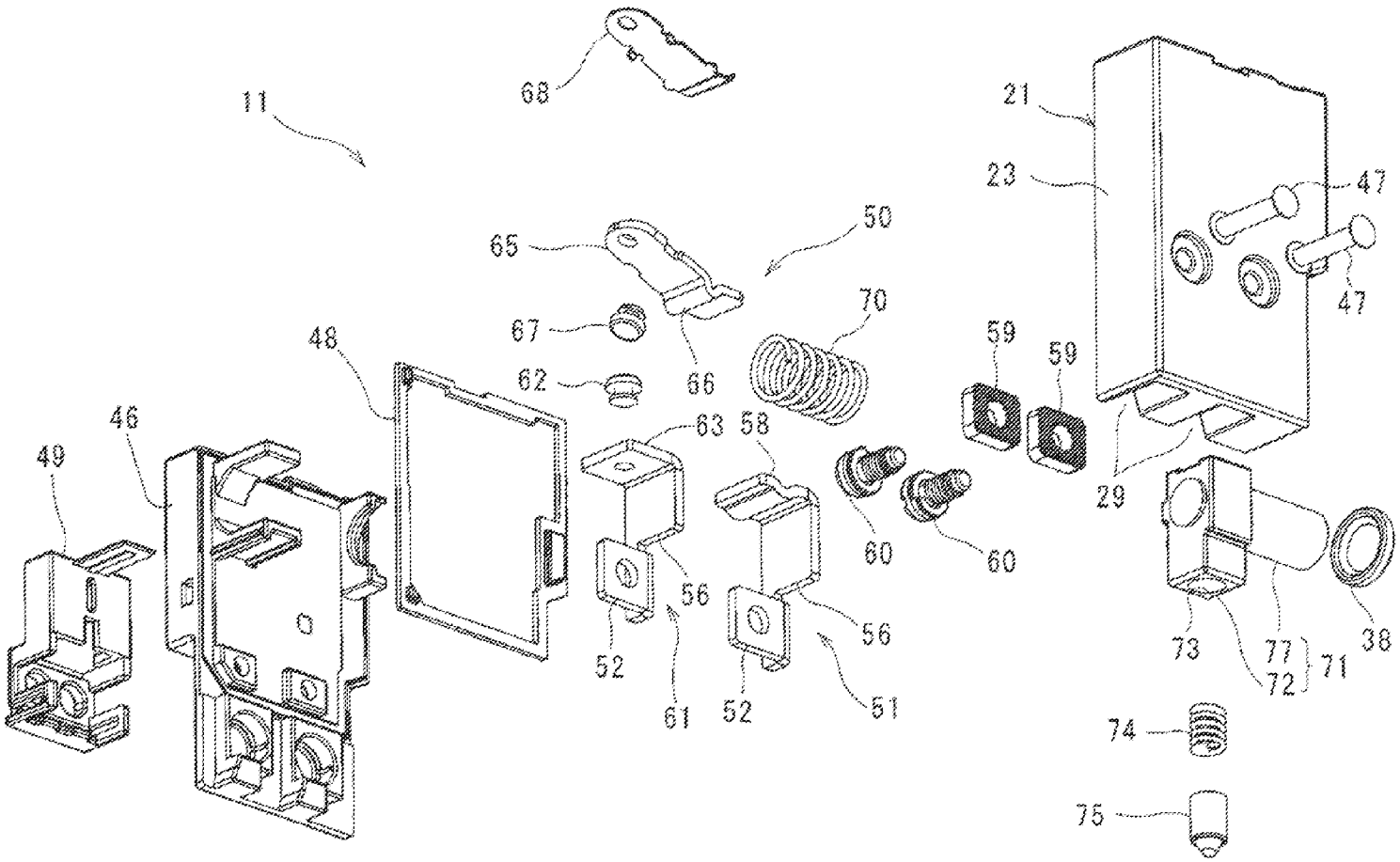
FIG. 4 is an exploded perspective view of the switch seen from the opposite side of FIG. 3.

As illustrated in FIG. 3, the contact actuating member 71 includes a rectangular parallelepiped guide 72 extending in the vertical direction, and a cylindrical operation shaft 77 that horizontally extends from the guide 72. As illustrated in FIG. 4, in the guide 72, a hollow portion 73 with a circular cross section is formed to extend upward from the bottom surface. Moreover, a pressing portion 75 with a conical leading end protruding from the bottom surface is fitted in the hollow portion 73 with the spring 74 interposed therebetween.

The contact actuating member 71 mounted in the main body 21 is accommodated in the third accommodation space 36 so that the guide 72 engages with the engagement rib 39. Moreover, the contact actuating member 71 is biased toward the front frame 22 by the return spring 70 installed between the rear frame 23 and the contact actuating member 71 with the operation shaft 77 passing through the round hole 37 of the main body 21 so as to protrude outside.

To assemble the switch 11 according to this embodiment, the washers 59, each provided with a female thread, are initially placed inside the first and second accommodation spaces 27 and 28. Then, the external-side connection portion 52 of the common terminal 51 is fitted in the first accommodation space 27, and the plate-shaped portion 54 is fitted in each of the first passage 41 and the first reinforcement portion-side passage 42. At this time, since the prop 53 of the common terminal 51 is locked to the edge of the first partition wall 30*a* and the plate-shaped portion 54 blocks up the first passage 41, entry of dust from the conductor insertion hole 29 is prevented and, as a result, sufficient dustproof performance is maintained. Moreover, since the plate-shaped portion 54 blocks the first reinforcement portion-side passage 42, entry of dust is prevented at two places: that is, at the first passage 41 and the first reinforcement portion-side passage 42. Accordingly, the dustproof performance is further improved. In addition, the leading end of the turn support portion 58 located at the bottom of the third accommodation space 36 is fitted against the first protrusion 26*a*. As a result, dust that has entered from the conductor insertion hole 29 is blocked by the turn support portion 58 and the first protrusion 26*a*, so that dust is prevented from arriving at the movable contact piece 65. In this way, the dustproof performance is further improved.

In the fixed contact terminal 61, like the common terminal 51, the external-side connection portion 52 is fitted in the second accommodation space 28, and the plate-shaped portion 54 is fitted in the second passage 43 and the second reinforcement portion-side passage 44. With this configuration, the leading end of the horizontal plane portion 63 located in a lower portion of the third accommodation space 36 is fitted against the second protrusion 35.

Next, the movable contact piece 65 is installed above the common terminal 51 and the fixed contact terminal 61 in the third accommodation space 36 so that the turning portion 66 of the movable contact piece 65 can engage with the concave portion 57 of the common terminal 51. The guide 72 is then also installed between the movable contact piece 65 and the upper frame 24 and the operation shaft 77 is driven through the round hole 37 to protrude outside so that the pressing portion 75 of the guide 72 pushes an end of the movable contact piece 65 with the slide contact plate 68 interposed therebetween. Thereafter, the return spring 70 is installed between the guide 72 and the rear frame 23 so that the guide 72 can be biased toward the front frame 22 by the spring force of the return spring 70.

In addition, grease as a viscous material is spread between the side end surface of the first partition wall 30*a* and the common terminal 51 and between the side end surface of the second partition wall 30*b* and the fixed contact terminal 61 through the guide groove 32. As a result, the gap between the first barrier wall 31*a* and the common terminal 51 and the gap between the second barrier wall 31*b* and the fixed contact terminal 61 can be more securely sealed, and thus the dustproof performance is improved. Moreover, since the grease is spread only between the side end surface of the first partition wall 30*a* and the common terminal 51 and between the side end surface of the second partition wall 30*b* and the fixed contact terminal 61, the amount of the grease that is spread can be suppressed. Accordingly, the manufacturing cost can be reduced, and deterioration of the dustproof performance due to deterioration of the grease with time can be prevented. Moreover, the grease may be further spread between the first reinforcement portion 33*a* and the common terminal 51 and between the second reinforcement portion 33*b* and the fixed contact terminal 61. As a result, the first reinforcement portion-side passage 42 and the second reinforcement portion-side passage 44 can be sealed, so that a dustproof performance is further improved.

Next, the cover 46 is locked to the main body 21 by the pin 47 with the frame gasket 48 interposed therebetween, the pin 47 being inserted in the through-hole 34 of the main body 21. The motor splicer 49 is then mounted on the front surface of the cover 46. Conductors such as lead wires or terminals are inserted between the external-side connection portions 52 of the common terminal 51 and the fixed contact terminal 61 and the washer 59, and, the screw 60 is tightened to make the connection.

The operation of the switch 11 which is assembled in accordance with the above-mentioned procedure will now be described. Starting from the initial state in which the user is not pushing the operation shaft 77, the operation shaft 77 fully projects from the main body 21 to its maximum by the return spring 70. Moreover, since the guide 72 is brought into contact with the front frame 22 and the pressing portion 75 pushes the edge of the slide contact plate 68 on the side of the turning portion 66, the movable contact 67 and the fixed contact 62 are separated from each other and the non-contact state is maintained.

Figure 7:
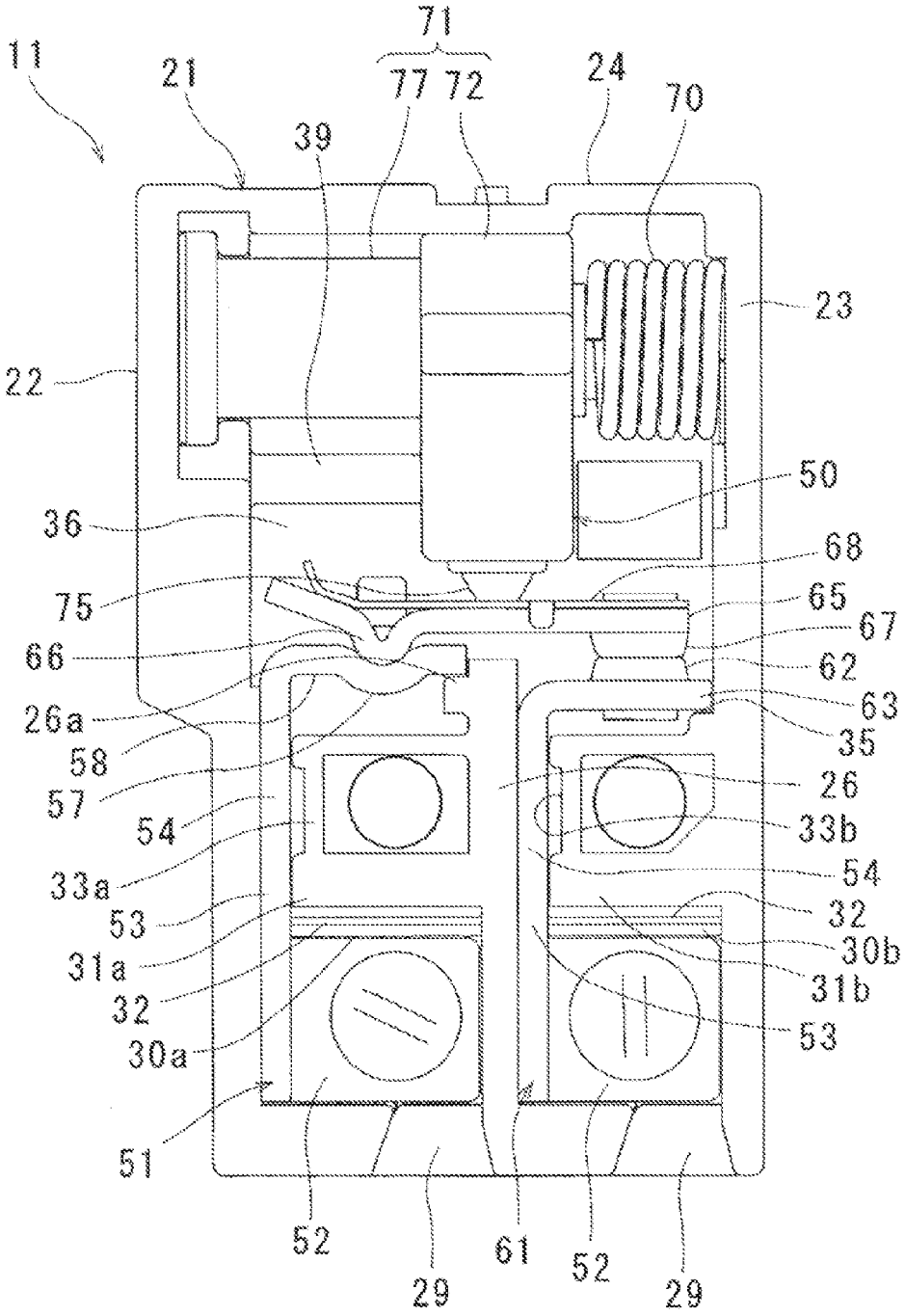
FIG. 7 is a front view illustrating the switch after being operated, with the cover removed.

When the user pushes the operation shaft 77 inward, as shown in FIG. 7 the guide 72 slides while being in contact with the upper frame 24 and the engagement rib 39, and moves toward the rear frame 23, against the resistance of the return spring 70. As a result, the pressing portion 75 pushes the substantial center of the slide contact plate 68, and thus the movable contact piece 65 turns about the turning portion 66 from the non-conduction position to the conduction position where the movable contact 67 and the fixed contact 62 are in contact with each other. The common terminal 51 and the fixed contact terminal 61 are then connected to each other, and thus the electrical energy to the motor is turned on.

When the user releases the pressing force applied to the operation shaft 77, the guide 72 is pressed by the spring force of the return spring 70 and is then moved toward the front frame 22 while remaining in contact with and sliding on the upper frame 24 and the engagement rib 39. Then, the pressing portion 75 pushes down on the edge of the sliding contact plate 68 on the other side of the turning portion 66. The movable contact piece 65 is thus kept at the non-conduction position in a state in which the guide 72 is stopped by being brought into contact with the front frame 22.

Experimental Comparison

The present applicants performed comparison experiments to compare the dustproof performance of the switch 11 according to the present invention with conventional switches.

In the experiment, grease was spread between the common terminal 51 and the guide groove 32 of the first partition wall 30*a* and between the fixed contact terminal 61 and the guide groove 32 of the second partition wall 30*b* as in the switch 11 illustrated in FIG. 6.

On the other hand, grease was spread in a comparative switch on the entire side end surface of the wall portion surrounding the space corresponding to the first accommodation space and the second accommodation space. The amount of the grease spread in the comparative example was about ten times that of the present embodiment.

As experimental conditions, the switches were turned on and off 1000 times in a sealed atmosphere filled with a concrete powder of 150 micrometers. At the conclusion of the experiment the switches were opened and it was confirmed that dust did not enter the inside thereof in both the present embodiment and in the comparative example.

Therefore, with the switch according to the present invention, the equal dustproof performance to the comparative example was confirmed even though the amount of grease was reduced to 1/10 times that of the comparative example.

There has thus been shown and described a novel switch which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A switch comprising:

a main body;

a plurality of terminals fixed to the main body;

a movable contact piece that is supported on the main body in a manner allowing displacement between a non-conduction position where each of the plurality of terminals are not connected to each other and a conduction position where each of the plurality of terminals are connected to each other; and a contact actuating member that is accommodated in the main body and displaces the movable contact piece from the non-conduction position to the conduction position in response to an external pressing force, wherein the main body includes an opening that coma communicates with the outside, a partition wall formed between the opening and the movable contact piece, a barrier wall formed above the partition wall, and a passage formed by an end portion of the barrier wall and an opposite wall that is opposite the end portion of the barrier wall, the partition wall crosses the passage to sectionally block the passage, and each of the plurality of terminals includes a connection portion and a blocking portion that bent from the connection portion and blocks the passage.

2. The switch according to claim 1, wherein the partition wall has a guide groove used to spread a viscous material between the partition wall and a corresponding terminal of the plurality of terminals.

3. The switch according to claim 1, further comprising:

a cover that covers the main body, wherein the main body further includes a reinforcement portion that fixes the cover in between the barrier wall and the movable contact piece, and a reinforcement portion-side passage formed by the reinforcement portion and a wall that is opposite the reinforcement portion, and the blocking portion of the corresponding terminal of the plurality of terminals blocks the reinforcement portion-side passage.

4. The switch according to claim 1, wherein the main body includes a protrusion provided between the barrier wall and the movable contact piece, wherein each of the plurality of terminals has a bent portion that is bent from the blocking portion on the opposite side of the connection portion of each of the plurality of terminals, and the bent portion is locked to the protrusion.

* * * * *